US009605913B2

(12) United States Patent
Al-Otaibi

(10) Patent No.: US 9,605,913 B2
(45) Date of Patent: Mar. 28, 2017

(54) TURBULENCE-INDUCING DEVICES FOR TUBULAR HEAT EXCHANGERS

(75) Inventor: Abdullah M. Al-Otaibi, Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 965 days.

(21) Appl. No.: 13/115,353

(22) Filed: May 25, 2011

(65) Prior Publication Data

US 2012/0298340 A1 Nov. 29, 2012

(51) Int. Cl.
*F28F 13/12* (2006.01)
*F28F 13/06* (2006.01)

(52) U.S. Cl.
CPC ..... *F28F 13/06* (2013.01); *F28F 13/12* (2013.01)

(58) Field of Classification Search
CPC ..... F28F 13/06; F28F 13/12
USPC ..... 165/109.1, 177, 179
See application file for complete search history.

(56) References Cited

U.S. PATENT DOCUMENTS

| | | | | | |
|---|---|---|---|---|---|
| 215,583 | A | * | 5/1879 | Dean | 138/38 |
| 499,567 | A | * | 6/1893 | Normand | 165/174 |
| 971,480 | A | * | 9/1910 | Wegner | 138/38 |
| 1,015,831 | A | * | 1/1912 | Pielock et al. | 138/38 |
| 1,313,624 | A | * | 8/1919 | Evans et al. | 138/38 |
| 1,496,509 | A | * | 6/1924 | Abell et al. | 181/280 |
| 2,034,822 | A | * | 3/1936 | Morrow | 138/38 |
| 2,068,477 | A | * | 1/1937 | Woodson | 432/209 |
| 2,081,612 | A | * | 5/1937 | Woodson | 138/38 |
| 2,300,058 | A | * | 10/1942 | Osborn, Jr. et al. | 62/392 |
| 2,389,166 | A | * | 11/1945 | Seaver | 165/9.1 |
| 2,492,298 | A | * | 12/1949 | Lenning | 165/164 |
| 2,599,325 | A | * | 6/1952 | Fritzberg | 138/28 |
| 2,660,198 | A | * | 11/1953 | Morrow | 138/38 |
| 2,677,394 | A | * | 5/1954 | Brinen et al. | 138/38 |
| 2,709,128 | A | * | 5/1955 | Krause | 422/310 |
| 2,861,596 | A | * | 11/1958 | Ipsen | 138/38 |
| 2,920,347 | A | * | 1/1960 | Joukainen et al. | 415/74 |
| 3,235,003 | A | * | 2/1966 | Smith | 165/135 |
| 3,269,420 | A | * | 8/1966 | Woodling | 138/38 |
| 3,327,779 | A | * | 6/1967 | Jacoby | 165/185 |
| 3,384,161 | A | * | 5/1968 | Malmstrom et al. | 165/94 |
| 3,457,982 | A | * | 7/1969 | Sephton | 159/13.2 |
| 3,582,045 | A | * | 6/1971 | Leybourne, III | 366/339 |
| 3,590,916 | A | * | 7/1971 | Mutzenberg et al. | 165/94 |
| 3,633,663 | A | * | 1/1972 | Tafel | 165/89 |
| 3,660,043 | A | * | 5/1972 | Schildknecht et al. | 422/251 |
| 3,769,959 | A | * | 11/1973 | Parker | 126/91 R |

(Continued)

FOREIGN PATENT DOCUMENTS

| | | |
|---|---|---|
| DE | 905972 | 3/1954 |
| EP | 0242838 | 10/1987 |

(Continued)

*Primary Examiner* — Ljiljana Ciric
(74) *Attorney, Agent, or Firm* — Abelman, Frayne & Schwab

(57) ABSTRACT

A heat exchanger tube for conveying a heat transfer fluid, into which one or more turbulence-inducing elements are fixedly positioned on a supporting member extending in spaced relation along the central axis of the tube. The turbulence-inducing elements have a first portion facing upstream and a second portion facing downstream. The entire exterior surface of the first portion forms a continuous solid surface that blocks and deflects the path of the flowing fluid.

28 Claims, 9 Drawing Sheets

(56) References Cited

U.S. PATENT DOCUMENTS

| | | | | | |
|---|---|---|---|---|---|
| 3,882,844 | A | * | 5/1975 | Ohara et al. | 126/360.2 |
| 3,886,976 | A | * | 6/1975 | Kardas et al. | 165/185 |
| 3,923,288 | A | * | 12/1975 | King | 366/336 |
| 3,942,765 | A | * | 3/1976 | Henrickson | 366/336 |
| 3,981,356 | A | | 9/1976 | Granetzke | |
| 3,995,663 | A | | 12/1976 | Perry | |
| 4,044,796 | A | | 8/1977 | Smick | |
| 4,068,830 | A | * | 1/1978 | Gray | 366/175.2 |
| 4,106,558 | A | * | 8/1978 | Neveux | 165/109.1 |
| 4,211,277 | A | * | 7/1980 | Grosz-Roll et al. | 165/109.1 |
| 4,265,275 | A | * | 5/1981 | Heller et al. | 138/38 |
| 4,314,587 | A | * | 2/1982 | Hackett | 165/184 |
| 4,327,671 | A | * | 5/1982 | Zimmer, Sr. | 138/38 |
| 4,336,838 | A | * | 6/1982 | Ely | 165/109.1 |
| 4,390,352 | A | * | 6/1983 | Grun | 165/185 |
| 4,443,389 | A | * | 4/1984 | Dodds | 261/153 |
| 4,481,154 | A | * | 11/1984 | Gough et al. | 261/94 |
| 4,502,509 | A | * | 3/1985 | Spitz | 138/38 |
| 4,534,409 | A | | 8/1985 | Cadars | |
| 4,545,426 | A | | 10/1985 | Collins | |
| 4,559,998 | A | * | 12/1985 | Counterman | 165/109.1 |
| 4,566,435 | A | * | 1/1986 | Kadotani et al. | 126/655 |
| 4,577,681 | A | * | 3/1986 | Hughes | 165/109.1 |
| 4,593,754 | A | * | 6/1986 | Holl | 165/109.1 |
| 4,595,047 | A | * | 6/1986 | Estienne | 165/109.1 |
| 4,641,705 | A | * | 2/1987 | Gorman | 165/109.1 |
| 4,670,103 | A | * | 6/1987 | Holl | 165/109.1 |
| 4,705,106 | A | * | 11/1987 | Hornack et al. | 165/179 |
| 4,718,480 | A | * | 1/1988 | Kito et al. | 165/94 |
| 4,753,535 | A | * | 6/1988 | King | 366/337 |
| 4,781,245 | A | * | 11/1988 | Freychet et al. | 138/38 |
| 4,784,218 | A | * | 11/1988 | Holl | 165/109.1 |
| 4,794,980 | A | | 1/1989 | Raisanen | |
| 4,812,049 | A | * | 3/1989 | McCall | 366/174.1 |
| 4,823,865 | A | * | 4/1989 | Hughes | 165/109.1 |
| 4,881,596 | A | | 11/1989 | Bergmann et al. | |
| 4,938,281 | A | * | 7/1990 | Dierbeck | 165/109.1 |
| 5,311,929 | A | | 5/1994 | Verret | |
| 5,497,824 | A | | 3/1996 | Rouf | |
| 5,758,967 | A | * | 6/1998 | King | 138/39 |
| 5,785,808 | A | * | 7/1998 | Litschert et al. | 159/47.1 |
| 5,983,994 | A | * | 11/1999 | Tsou | 165/109.1 |
| 6,027,241 | A | * | 2/2000 | King | 165/109.1 |
| 6,354,514 | B1 | * | 3/2002 | Henricson et al. | 239/128 |
| 6,582,584 | B2 | | 6/2003 | Lee et al. | |
| 6,615,872 | B2 | * | 9/2003 | Goebel et al. | 138/38 |
| 6,732,788 | B2 | * | 5/2004 | Keith et al. | 165/109.1 |
| 7,673,834 | B2 | * | 3/2010 | Harman | 244/199.1 |
| 7,766,279 | B2 | * | 8/2010 | Harman | 244/199.1 |
| 7,887,764 | B2 | * | 2/2011 | Jernberg | 422/224 |
| 8,381,870 | B2 | * | 2/2013 | Harman | 181/249 |
| 8,425,656 | B2 | * | 4/2013 | Ciora et al. | 95/45 |
| 9,004,152 | B2 | * | 4/2015 | Yoshihara | 165/109.1 |
| 9,045,693 | B2 | * | 6/2015 | Wolfe | |
| 9,243,851 | B2 | * | 1/2016 | Viswanathan | F28F 1/40 |
| 9,255,745 | B2 | * | 2/2016 | Bertolotti | F28F 1/124 |

FOREIGN PATENT DOCUMENTS

| | | | | |
|---|---|---|---|---|
| EP | 1947386 | A1 * | 7/2008 | F23M 9/00 |
| EP | 1947386 | B1 * | 8/2013 | |
| FR | 2911673 | A1 * | 7/2008 | |
| GB | 16948 | | 0/1912 | |
| JP | 60207898 | | 10/1985 | |
| WO | 8401818 | | 5/1984 | |

* cited by examiner

TURBULENCE-INDUCING DEVICES FOR TUBULAR HEAT EXCHANGERS

RELATED APPLICATIONS

Not Applicable

BACKGROUND OF THE INVENTION

Field of the Invention

This invention relates to tubular heat exchangers, and in particular to turbulence-inducing devices positioned in the tubes of the tubular heat exchanger that minimize or prevent fouling caused by the heat transfer fluids and enhance or maintain the overall heat transfer coefficient over the operational life of the tubular members.

Description of Related Art

Heat exchangers are found in many industrial and commercial applications. In the design of heat transfer equipment, an important factor includes the footprint of the exchanger relative to the capacity of fluid that is to be heated or cooled (the "receiving fluid"), as well as the requisite flow of the heating or cooling fluid (the "transferring fluid"). The heat transfer coefficient between the transferring fluid and the receiving fluid should be maximized to achieve the smallest allowable footprint of the heat exchanger.

Another factor that must be considered in designing heat exchangers is the tendency of heating or cooling fluids to foul in the tubes through which they pass. One detrimental effect of fouling is a lowering of the heat transfer coefficient. The thermal conductivity of the fouling layer is less than that of the tube material, which increases the heat transfer resistance, reduces the efficacy of the heat exchanger, and increases the tube skin temperature. Another negative effect of fouling is that the formation of depositions on the interior surface of the tubes reduces their cross-sectional area, causing increased resistance to the fluid flow and an increase in the pressure drop across the unit.

In refinery and petrochemical plants, problems caused by tube fouling are very expensive to remedy. Capital expenditures are higher due to the increased size of the heat exchanger (e.g., selecting heat exchangers with 10-50% greater surface area to accommodate conventional fouling expectations), the associated increase in requisite area within the plant, the higher strength and size foundations, and the extra transport and installation costs. Furthermore, the cost of operating the unit is increased due to additional fuel, electricity or process steam requirements. In addition, production losses occur during planned and emergency plant shutdowns due to fouling and associated system failures.

Various attempts to minimize or prevent fouling problems have been advanced. One common prevention technique is to use a fouling factor in the design phase of a heat transfer unit that includes increasing the heat transfer surface area, either by increasing the number of tubes or the tube length. Such a fouling factor is considered a necessary aspect of heat exchanger design, based on acceptance of the fact that fouling is inevitable. In addition to the aforementioned costs associated with selecting a larger heat exchanger, an additional concern is that the excess surface area calculated with a fouling factor can result in start-up complications and actually encourage more fouling. That is, it is common that at start-up, sludge and dirt migrate into dead zones and low velocity locations. The effect of increasing the number of tubes is to decrease the fluid flow velocity, thereby increasing the likelihood of fouling. Similarly, increasing the tube length results in lower fluid pressure, also increasing the likelihood of fouling.

Other known attempts to mitigate fouling problems involve the use of in-line mechanical cleaning devices to remove fouling build-up inside the tubes. These devices, which generally require direct physical contact with the inner tube surface, have not been especially successful in preventing fouling.

Deflection insertions are also another general category of fouling prevention or mitigation devices. For instance, U.S. Pat. No. 1,015,831 to Pielock et al. discloses a device that is inserted in a pipe to deflect the central and peripheral flow of liquid. Fluid along the side walls is directed toward the center of the pipe, and fluid moving along the longitudinal center line is directed towards the side walls. The device is constructed as a ring installed on the pipe's inner surface having a diametrically disposed web or a plurality of webs that form an apex pointed against the direction of fluid flow. However, the device described in Pielock et al. is mainly intended to diffuse central flow in multiphase fluid for equal distribution. Furthermore, in the context of a heat exchanger's transferring tube, fouling will predictably occur at the interface of the Pielock device and the tube's inner surface.

U.S. Pat. No. 3,995,663 to Perry describes a ferrule for insertion at the inlet of a vertical shell-and-tube heat exchanger, including a flange and shoulder to seat upon the tube sheet, a bore and a cylindrical portion as an extension of the bore to facilitate formation of a solid column of liquid entering the tube. The ferrule also includes an outwardly extending connecting wall that distributes fluid towards the apex of a conical member. Fluid entering the bore is directed to the side walls due to the shape of the conical member. Apparently, the purpose of the device is to distribute liquid to the walls of the ferrule rather than to the tube walls to provide liquid in the form of a falling film on the inner surfaces of the vertical tubes for evaporation. Therefore, application of this structure is necessarily limited to vertical shell-and-tube heat exchangers.

U.S. Pat. No. 5,311,929 to Verret and U.S. Pat. No. 4,794,980 to Raisanaen both disclose air-to-air heat exchangers that include cone-shaped elements disposed in each tube along a central rod. The cones serve as deflectors to create turbulence in the gases flowing through the tube. The elements disclosed in Verret are attached using a twisted strip of material bent inside the tubes to provide contact with the tube's internal surface. The conical elements described in Raisanaen are open on the downstream end, thus allowing fouling and sludge accumulation inside the cone.

The above-described references each have drawbacks that render them unsuitable for minimizing or preventing fouling. Additional known attempts to prevent fouling rely upon inserts fixed to the inner wall of the tube. However, fouling will eventually accumulate at, and proximate to the attachment points, which hinders removal of the inserts and thus complicates cleaning the inner surface of the tube.

Therefore, it is an object of the present invention to provide an apparatus for use in the tubes of heat exchangers that eliminates or minimizes fouling of the interior surfaces of the tubes.

It is another object of the present invention to provide an apparatus for use in tubes of heat exchangers that maintains the heat transfer coefficient over the operational life of the tubes.

It is still another object of the present invention to provide an apparatus for use in the tubes of heat exchangers that permits the designer to utilize the minimum theoretical heat exchanger size or capacity for a given application.

SUMMARY OF THE INVENTION

The above objects and further advantages are provided by the apparatus of the present invention for promoting turbulence in the tubes of a heat exchanger conveying the heat transfer fluid that in one embodiment comprehends a turbulence-inducing element formed with a conical upstream portion, from the base of which a second portion extends downstream. In one embodiment, the second portion is convex or hemi-spheroid in shape. In another embodiment, the second portion is conical in shape. In yet another embodiment, the second portion is shaped as a conical frustum. In yet another embodiment, the second portion is shaped as a truncated convex shape with a rounded edge surface. In another aspect of the present invention, longitudinal grooves and/or protrusions are formed on the exterior surfaces of the turbulence-inducing elements. The solid or closed downstream ends of the elements prevent accumulation of deposits.

A plurality of these turbulence-inducing elements are secured to a structural support member that is centrally positioned along the longitudinal axis of the tube. In a preferred embodiment, a plurality of the turbulence-inducing elements extend along substantially the entire length of the tube. The centrally-positioned support member can be a rigid member, such as a rod, or a flexible material, such as a solid or stranded wire or cable. Alternatively, a plurality of centrally-positioned links can be used to join the turbulence-inducing elements.

In a further aspect of the invention, springs can be provided at both ends of the centrally-positioned support member, to maintain the system in tension and absorb sudden load variations.

In the practice of the method of the invention, the apparatus including a plurality of turbulence-inducing elements mounted on the supporting member is inserted into one or more of the tubes of tube-type heat exchangers to induce turbulent fluid flow inside the tube, particularly at the inner wall of the tube. The supporting member is attached to the ends of the tube. The supported elements are dimensioned and configured so that they do not touch the adjacent inner wall of the tube in which they are mounted. During operation, the fluid in the tube flows across the symmetrically-shaped surfaces of the turbulence-inducing elements, which in turn applies tension to the supporting member and which thereby maintains the elements along the center of the tube.

Preventing formation of a quiescent boundary layer enhances the heat transfer coefficient and breaks down or prevents formation of the stagnant film on the inner surface of the tubes associated with the boundary layer. The apparatus and method of the invention also result in a thorough mixing of the heat transfer fluid as it passes through the tube, thereby enhancing its efficiency.

BRIEF DESCRIPTION OF THE DRAWINGS

The invention will be described in further detail below and with reference to the attached drawings in which the same or similar elements are referred to by the same reference numerals, and in which:

FIGS. 14A, 14B, and 14C are a downstream end view, side perspective view, and upstream end view, respectively, of another embodiment of a turbulence-inducing element of the present invention in which the upstream conical surface portion is provided with a plurality of protruding stud elements;

DETAILED DESCRIPTION OF THE INVENTION

Figure 1:
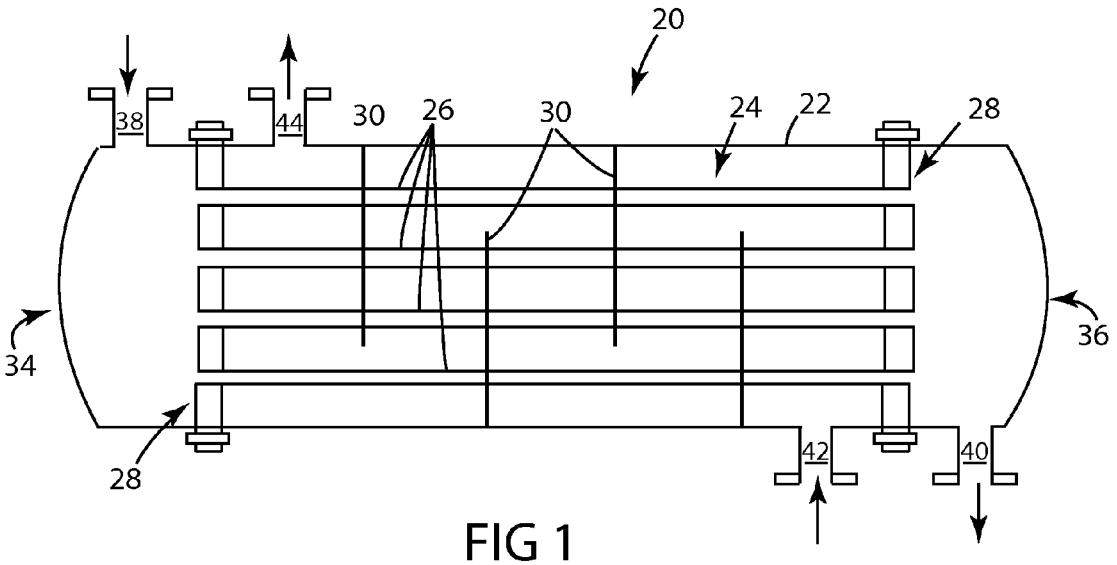
FIG 1 Prior Art
FIG. 1 is a longitudinal cross-sectional view of a typical shell-and-tube heat exchanger of the prior art.

Referring to FIG. 1, there is shown a longitudinal cross-sectional view schematically depicting the arrangement of elements in a typical shell-and-tube heat exchanger 20 of the prior art. A bundled tube heat exchanger is a well known configuration of a type of heat transfer equipment in which a plurality of tubes convey a heat transfer fluid. By means of the thermal conductivity of the tubes, heat is transferred to a receiving fluid that contacts the exterior surface of the tubes.

Exchanger 20 includes a shell 22 and a tube set 24 having a plurality of tubes 26. The tubes 26 are supported at their ends by tube sheets 28, also known as end plates. In the typical construction of a bundled tube heat exchanger, a series of baffles 30 are provided through which the plurality of parallel tubes 26 pass.

In operation, heat transfer fluid is introduced via a tube set inlet 38 proximate to the first end 34 of the shell-and-tube heat exchanger 20, passes through the tubes 26, and is discharged from a tube set outlet 40 proximate to the opposite end 36 of the heat exchanger 20. While heat transfer fluid is passing through tubes 24, receiving fluid is introduced into the shell inlet 42 proximate the end portion 36. Receiving fluid contacts the outer surfaces of the tubes 26 as it passes over them and around the baffles 30, thereby undergoing a temperature change. Heated or cooled fluid from the shell 22 is discharged via the shell outlet 44 proximate to the first end 34.

Figure 2:
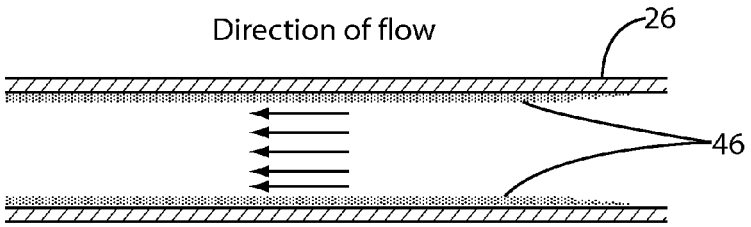
FIG 2 Prior Art
FIG. 2 is a longitudinal cross-sectional view of a prior art tube carrying heat transfer fluid in a tubular-type heat exchangers schematically illustrating the boundary layer phenomenon.

As noted above, a common problem encountered in the tubes of shell-and-tube and other tubular heat exchangers is fouling of the inner walls and plugging of the tubes carrying the heat transfer fluid. This fouling leads to decreased cross-sectional area of the tubes, thus increasing the pressure drop across the tubes, and also causing decreased thermal conductivity. This phenomenon is schematically illustrated in FIG. 2, showing a boundary layer 46 formed on the inner surface of the tube 26. As a result, the flow velocity of the boundary layer 46 is very low, reducing the heat transfer coefficient and promoting adhesion of impurities to the inner surface of the tube wall.

Heat transfer fluids can be gases or liquids, including high viscosity lube oil. The selection of the number, size and shape of turbulent-inducing elements depends on the allowable pressure; type of need; enhancement of heat transfer; and need for fouling mitigation. For example, if the pressure drop of a specific heat exchanger is small and more turbulence is required, a preferred embodiment would be to use a large number of turbulent-inducing elements, of relatively small size.

As will be apparent to one of ordinary skill in the art, although a shell-and-tube heat exchanger is depicted in FIG. 1, the turbulence-inducing elements of the present invention and their arrangement is applicable to other tubular heat exchangers including, but not limited to, double pipe heat exchangers and air-cooled heat exchangers.

Figure 3A:
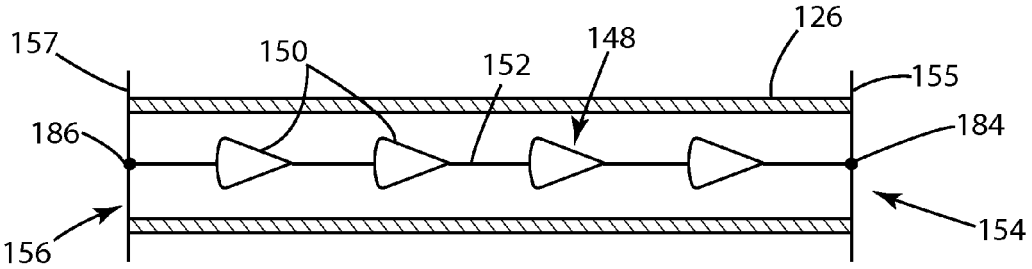
FIG. 3A is a longitudinal cross-sectional view of a tube carrying heat transfer fluid in which the turbulence-inducing elements of the present invention are mounted.
Figure 3B:
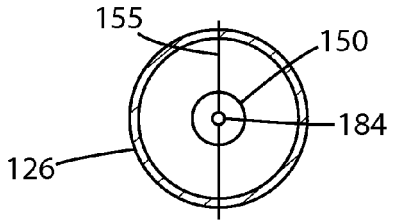
FIG. 3B is an end view of the tube shown in FIG. 3A.

FIGS. 3A and 3B show a heat exchanger tube 126 according to the present invention including an apparatus 148 having a plurality of turbulence-inducing elements 150 positioned centrally and spaced apart along the length of tube 126 positioned along a structural support element 152. There are a variety of ways to assemble the present invention, including casting them in place and/or "stringing" the turbulence-inducing elements 150 on the rod, by welding, by use of suitable adhesives, and the like. Note that while the figures show a plurality of identical turbulence-inducing elements 150, turbulence-inducing elements of different shapes and types can be positioned on the structural support element 152. Various embodiments of alternative shapes and types of turbulence-inducing elements are described below with respect to FIGS. 5-15. In addition, the total number of turbulence-inducing elements, the spacing between adjacent turbulence-inducing elements, the dimensions of the turbulence-inducing elements, including length and diameter relative to the tube diameter and other structural parameters, and/or the shape of turbulence-inducing elements, are determined by factors including, but not limited to, the heat transfer fluid flow rate and viscosity, increased back pressure that can result from a large diameter turbulence-inducing element blocking too much of the flow path, the maximum allowable pressure drop, and the target heat transfer coefficient.

Figure 3C:
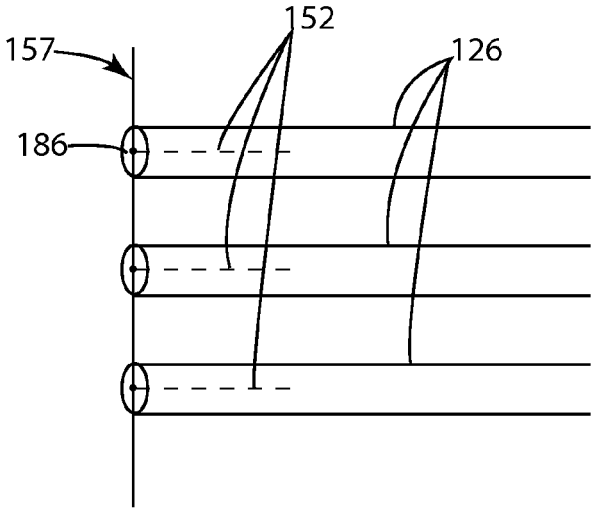
FIG. 3C is side perspective view of one embodiment in which each linking wire can be routed across a number of tube ends.
Figure 3D:
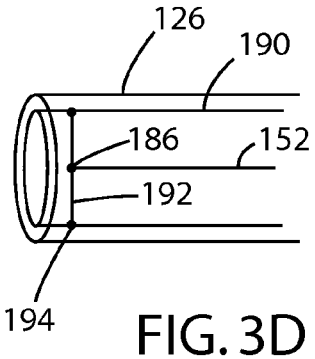
FIG. 3D is side perspective view of one embodiment in which a tube sleeve can be inserted into the tubes.
Figure 3E:
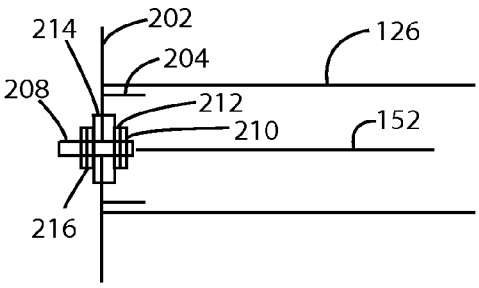
FIGS. 3E and 3F show a side perspective view and end view, respectively, of one embodiment showing a first linking wire routed across a row of tube ends and a second linking wire routed across a column of tube ends.
Figure 3F:
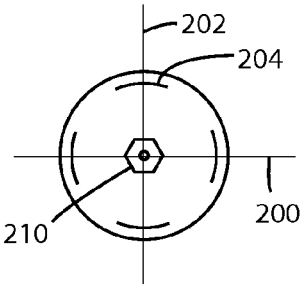
Figure 3G:
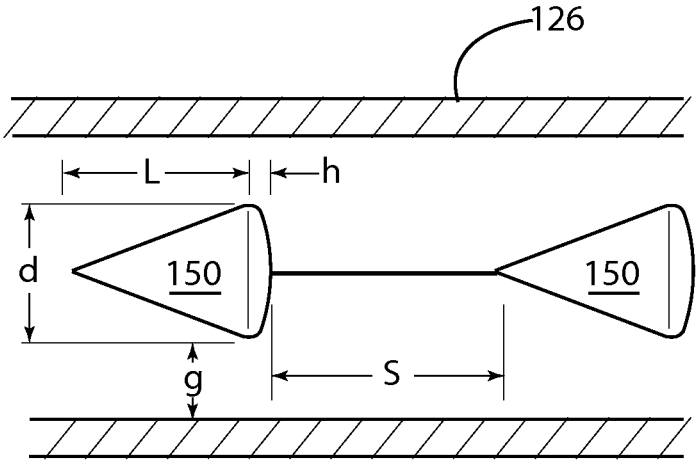
FIG. 3G is a diagram used to describe relative dimensions according to one example.

The dimensions and spacing of the turbulence-inducing elements 150 relative to the size of the tube 126 are described according to the following formulas and with reference to FIG. 3G, according to one example.

A minimum gap (g) is maintained between the inside diameter (ID) of the tube and the outer diameter (d) of the turbulence-inducing element, according to the following formula:

$$g \geq 0.25*\mathrm{ID} \tag{1}$$

The diameter of the turbulence-inducing element (d) is determined relative to the inside diameter (ID) of the tube, according to the following formula:

$$d=ID-2g \tag{2}$$

The length (L) of the turbulence-inducing element is determined relative to the inside diameter (ID) of the tube, according to the following formula:

$$1.25(ID)<=L<=1.5(ID) \tag{3}$$

The space (S) between adjacent turbulence-inducing elements is determined relative to the diameter (d) of the turbulence-inducing element and the gap (g) (described above), according to the following formula:

$$S=3.5*d/g \tag{4}$$

The depth (h) of the second portion extending towards the downstream end of the tube is determined relative to the diameter (d) of the turbulence-inducing element, according to the following formula:

$$0 \leq h \leq 0.25d \tag{5}$$

The above formulas used for calculating the dimensions and spacing of the turbulence-inducing elements are provided by way of example. In general, the relative dimensions and spacing of the turbulence-inducing elements can be modified in order to strike a balance between preventing or minimizing the formation of a boundary layer and the potential for erosion of the inner surface of the tube due to increased fluid flow rate against the inner surface walls.

Materials of construction suitable for the turbulence-inducing elements and the structural support element include: plastics, including PTFE (Teflon) and nylon; natural or synthetic rubbers; wood or wood-based composites; or relatively soft metals such as aluminum, titanium, and copper.

The ends 184 and 186 of the structural support element 152 are attached at the upstream end 154 and the downstream end 156, respectively. The ends 184, 186 can include, for example, ball stops that are attached to a linking wire 155 at the upstream end 154 and a linking wire 157 at the downstream end 156 of the tube.

In one embodiment, as shown in FIG. 3C, each linking wire 155 and 157 can be routed across a number of tube ends.

In a another embodiment shown in FIG. 3D, a tube sleeve 190 can be inserted into the tubes, with a linking wire 192 attached, such as by welds 194, to points on the inner wall of the tube sleeve that are 180 degrees apart. The end 185 of structural support element 152 is then connected to the center of linking wire 192, such as with a ball stop.

In a further embodiment shown in FIGS. 3E and 3F, linking wire 200 is routed across a row of tube ends, and linking wire 202 is routed across a column of tube ends. The end of structural support element 152 terminates in a threaded rod 208. Structural element 152 can be a wire, in which case the threaded rod 208 can be attached such as by welding, by crimping or by ball stop. Alternatively, structural element 152 can be a rod, with threaded rod 208 merely being the end of structural element 152, to which a thread has been applied, as with a chuck. The linking wires 200 and 202 cross at perpendicular angles at the centers of each tube 126. A pair of internal guides 204 are provided for each tube 126 that linking wires 200 and 202 are routed across. Threaded rod 208 is then attached to the intersection of linking wires 200 and 202, for example using internal nut 210, internal washer 212, external washer 214 and external nut 216. Alternatively, linking wires 200 and 202 can be formed as a mesh, with washers at their intersecting points at the center of each tube. Threaded rod 208 can then be inserted through the central washer and secured with an external nut.

Figure 4:
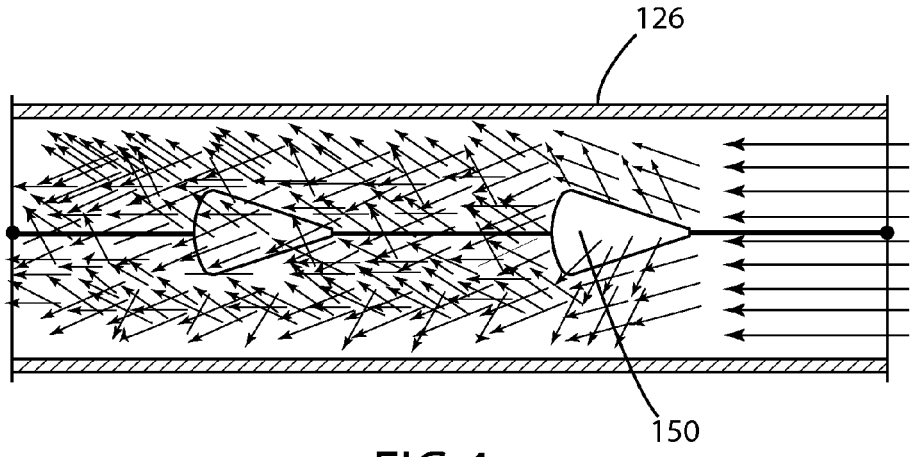
FIG. 4 is a longitudinal cross-sectional view of a tube carrying heat transfer fluid according to the present invention schematically depicting the turbulent fluid flow within the tube.

The turbulence-inducing elements 150 are configured and dimensioned to direct the flowing heat transfer fluid towards the inner surface of the tube wall. For example, FIG. 4 schematically illustrates the turbulent flow that is created inside the inner tube 126 and, in particular, the flow that is created around the turbulence-inducing elements 150. According to the present invention, fluid flow is directed toward the tube's inner wall surfaces to thereby disrupt the boundary layer that would otherwise form along the surface of tubes not having the turbulence-inducing elements 150, with the result being that a region of turbulence is created downstream of the maximum diameter of the device. The likelihood of accumulation of impurities on the inner surface of the tubes is thereby eliminated or minimized because of the turbulent flow created by the apparatus of the present invention.

In addition, FIG. 4 shows that as the fluid flow moves along the tube length, and additional downstream turbulence-inducing elements are encountered, the deflection of fluid by the turbulence-inducing elements is cumulative. For example, a first turbulence-inducing element generally receives a generally laminar flow of fluid from the upstream end of the tube, while a second turbulence-inducing element receives fluid with a flow path that has been deflected by the first turbulence-inducing element, and then a third turbulence-inducing element receives fluid with a flow path that has been deflected by both the first and second turbulence-inducing elements.

Figure 5A:
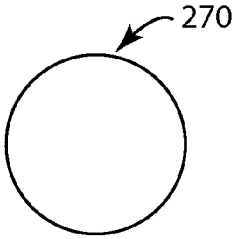
FIGS. 5A, 5B, and 5C are a series of front, side, and rear views, respectively, of one embodiment of a turbulence-inducing element of the present invention with a downstream portion in the form of a convex portion extending from the base of a conical portion.
Figure 5B:
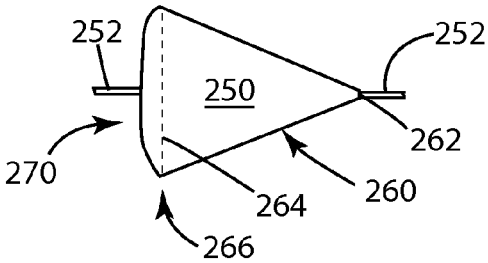
Figure 5C:
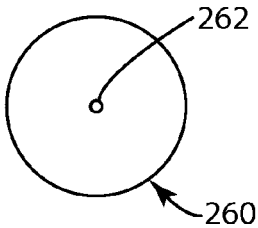

FIGS. 5A, 5B, and 5C show a series of front, side, and rear views of one embodiment of a turbulence-inducing element 250. Turbulence-inducing element 250 includes a first portion 260 which is positioned towards the upstream end of the tube and a second portion 270 towards the downstream end of the tube. The distal end 262 of the first portion 260 has a cross-sectional area smaller than the maximum cross-sectional area of the second end portion 270. In general, the cross-sectional area of the first portion increases in the direction of fluid flow as arranged in the tube, and the cross-sectional area of the second portion decreases in the direction of fluid flow. Note, however, that the cross-sectional area of the distal end 262 of the first portion 260 should not be larger than the diameter of structural support element 252, to prevent a perpendicular impingement of fluid particles on the distal end 262.

Furthermore, in preferred embodiments of the present invention, the turbulence-inducing elements are symmetrical about their longitudinal axes, i.e., from the upstream portion to the downstream portion. Such an arrangement permits a balanced distribution of the transferring fluid within the tube and along the inner wall of the cylindrical tube as shown in FIG. 4. The thorough mixing of the heat transfer fluid increases the overall efficiency of the unit by disrupting the generally laminar flow of the liquid.

The first portion 260 of the turbulence-inducing element 250 is configured generally in the shape of a conical frustum, with the distal end 262 formed as a truncated apex or a truncated curved or rounded apex. In certain embodiments, the truncation can be minimized such that the distal end approaches an apex or rounded apex, depending on the diameter of the structural support element 252. In a preferred embodiment, the distal end 262 is configured so as to minimize any energy loss associated with localized pockets of turbulence, which would otherwise deleteriously increase the pressure drop along the tube.

The turbulence-inducing element 250 can be attached to the structural support element 252 by any of a number of means. In a preferred embodiment, the turbulence-inducing element 250 can be cast on the wire or rod of the structural support element 252. Alternatively, the turbulence-inducing element can be hollow or have a light-weight core between the distal end and the center of the convex second portion so that the rod can be inserted through and welded in place. Other examples include attaching the turbulence-inducing element 250 to structural support element 252 by crimping or pinning.

In one preferred embodiment, the shape of the second portion 270 facing the downstream end of the tube is generally convex. The edges 266 of the interface 264 between the imaginary transverse plane of the base of the first portion 260, e.g., a plane characterized by a plurality of circumferential lines of a cone-shaped structure, and the imaginary base of the second portion 270 (shown in broken lines) are preferably rounded or partially rounded.

The configuration of the second portion can be any suitable shape that minimizes or eliminates edges, as this will minimize or eliminate the accumulation of material that can promote surface fouling of the second portion.

In preferred embodiments, the configuration of the second portion includes a closed outer surface to prevent heat transfer fluid from accumulating within the turbulence-inducing elements.

Figure 6:
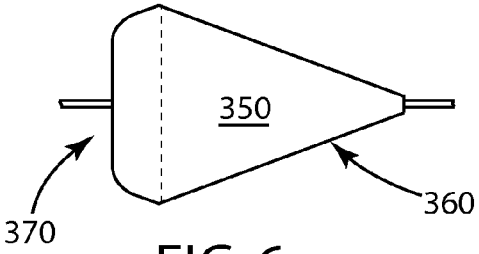
FIG. 6 is a side perspective view of another embodiment of a turbulence-inducing element of the present invention with a downstream portion in the form of a truncated convex shape with a rounded edge surface.
Figure 7:
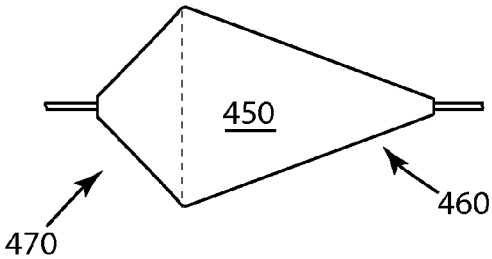
FIG. 7 is a side perspective view of a further embodiment of a turbulence-inducing element of the present invention with a downstream portion having a shape that is conical with an apex.
Figure 8:
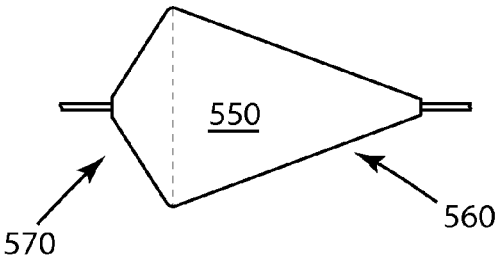
FIG. 8 is a side perspective view of an additional embodiment of a turbulence-inducing element of the present invention with a downstream portion having a shape that is conical with a rounded apex.
Figure 9:
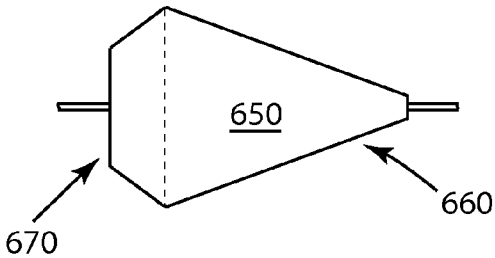
FIG. 9 is a side perspective view of a still further embodiment of a turbulence-inducing element of the present invention with a frustoconical downstream portion.
Figure 10:
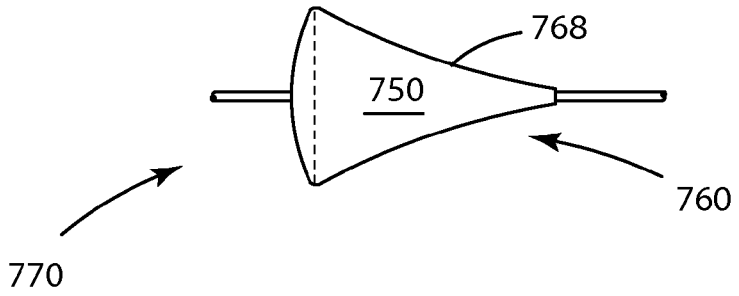
FIG. 10 is a side perspective view of an embodiment of a turbulence-inducing element of the present invention having a generally conical upstream portion with a concave lateral outer surface.
Figure 11:
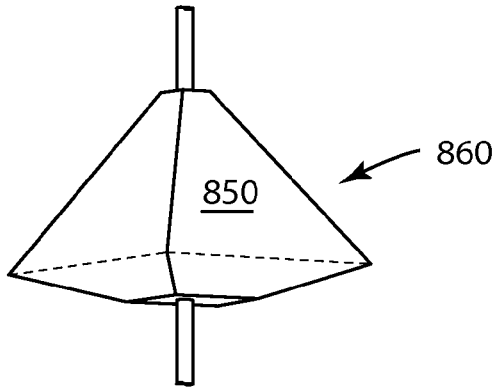
FIG. 11 is a side perspective view of a further embodiment of a turbulence-inducing element of the present invention having an upstream portion having a pyramidal structure.
Figure 12:
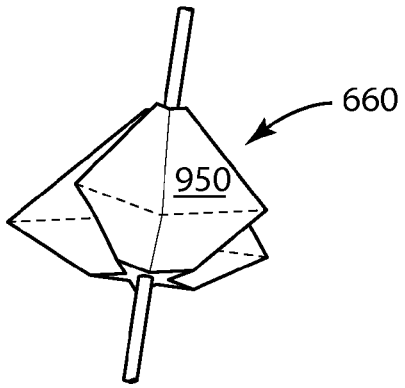
FIG. 12 is a side perspective view of another embodiment of a turbulence-inducing element of the present invention having an upstream portion with a star-shaped pyramidal structure.

As shown in FIG. 5, the shape of the second portion can be a convex shape or a hemi-spheroid or other curvilinear shapes. FIGS. 6-9 show various additional examples of suitable shapes for the second portion. In one embodiment, as shown in FIG. 6, a turbulence-inducing element 350 includes a first portion 360 in the configuration of a conical frustum and a second portion in the configuration of a truncated convex shape or a hemi-spheroid shape. In another embodiment, as shown in FIG. 7, a turbulence-inducing element 450 includes a first portion 460 in the configuration of a conical frustum and a second portion 470 comprising a small surface area truncated apex, e.g., with the area of the truncated portion approaching the cross-sectional area of the supporting member. In a further embodiment, as shown in FIG. 8, a turbulence-inducing element 550 includes a first portion 560 in the configuration of a conical frustum and a second portion 570 comprising a surface having a rounded apex. In still another embodiment, as shown in FIG. 9, a turbulence-inducing element 650 includes a first portion 660 in the configuration of a conical frustum and a second portion 670 comprising surface having a relatively large area truncated apex, e.g., with the area of the truncated portion many times larger than the cross-sectional area of the rod, as shown in FIG. 9.

One of ordinary skill in the art will appreciate that other configurations can be applied to the second portion of the turbulence-inducing elements according to the present invention, including a cross-sectional area that generally decreases in the direction of fluid flow.

Figure 14A:
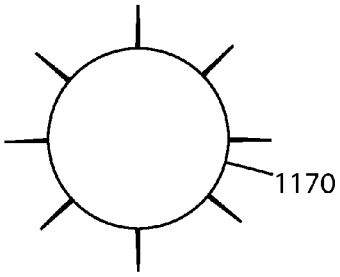
Figure 14C:
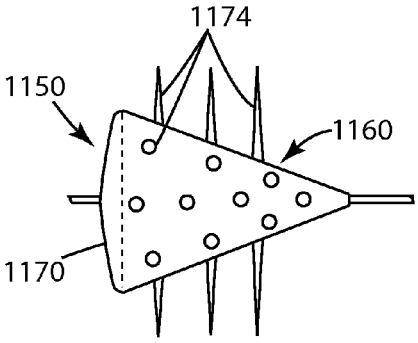
Figure 14C:
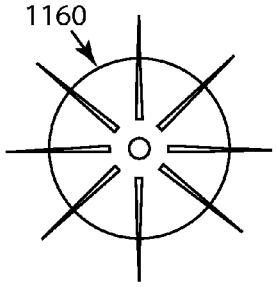

The first portion of the turbulence-inducing elements can also be one of many shapes that have a cross-sectional area that generally increases along the direction of fluid flow, with the exception of embodiments shown in FIGS. 14-15 in which protruding elements are provided on the lateral surface of the first portion to induce additional turbulence and, in one embodiment, to assist in maintaining the turbulence-inducing elements aligned with the longitudinal axis of the tube. For instance, as shown in FIGS. 5-9, the first portion can be a conical frustum. In another embodiment, and referring to FIG. 10, a turbulence-inducing element 750 includes a first portion 760 in the shape of a conical frustum having a concave lateral surface 768. In a further embodiment, and referring to FIG. 11, a turbulence-inducing element 850 includes a first portion 860 in the shape of a pyramidal frustum. Embodiments of the first portion 860 preferably have bases with at least five sides to minimize pocket areas along the lateral surface of the pyramid, and more preferably have bases with an even number of sides to provide a symmetrical turbulence-inducing element. In an additional embodiment, and referring to FIG. 12, a turbulence-inducing element 950 includes a first portion 960 in the shape of a star pyramid frustum. In certain embodiments, including those described with respect to FIGS. 5-12, the first portion is configured so that energy loss is minimized along the direction of fluid flow.

One of ordinary skill in the art will appreciate that other configurations can be applied to the first portion of the turbulence-inducing elements according to the present invention that have a cross-sectional area that generally increases in the direction of fluid flow.

Figure 13A:
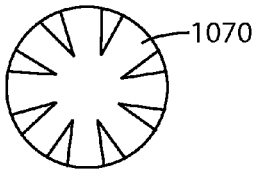
FIGS. 13A, 13B, and 13C are a downstream end view, side perspective view, and upstream end view, respectively, of another embodiment of a turbulence-inducing element of the present invention having surface grooves extending in the direction of fluid flow.
Figure 13B:
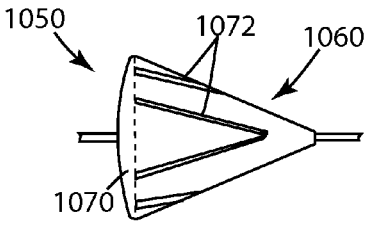
Figure 13C:
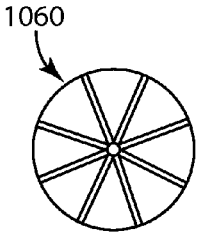

In further embodiments, and referring to FIGS. 13-15, one or more of the turbulence-inducing elements used in a tube can include additional features or extensions. In particular, with reference to FIGS. 13A, 13B, and 13C, a turbulence-inducing element 1050 includes grooves 1072 distributed about the circumference of the element 1050. The grooves generally begin at the halfway point of the first portion 1060 (which in the embodiment shown is in the configuration of a conical frustum), and extend downstream along its lateral surface to the base of the first portion 1060. The grooves 1072 begin at a shallow depth, with the depth increasing as the grooves extend downstream, and the grooves end at the intersection between the base of the first portion and the second portion; upon encountering the solid second portion, the streams are directed out toward the tube wall. The grooves are preferably distributed evenly around the conical frustum to maintain the device at the tube center, i.e., to prevent fluid flow from creating asymmetrical forces that could displace the turbulence-inducing elements 150 towards the inner wall of the tube. In a preferred embodiments, the grooves 1072 are straight to avoid rotation-inducing forces on the turbulence-inducing elements, which could cause them to separate from the structural support element. In an alternate embodiment, the symmetrical grooves are curved, with mirrored curved grooves at complementary locations that prevent rotation of the turbulence-inducing elements.

In another embodiment, with reference to FIGS. 14A, 14B, and 14C, a turbulence-inducing element 1150 includes a first portion 1160 having conical studs or spikes 1174 distributed on its lateral surface. These studs 1174 increase turbulence within the tube, thus providing a further enhancement to the anti-fouling and thermal mixing benefits of the turbulence-inducing element of the present invention. The studs can be conical, frustoconical, pyramidal, cylindrical, hemi-cylindrical, or of other suitable shapes. In one embodiment, these projections from the first portion 1160 can extend to the inner tube walls, maintaining the device at the tube center to avoid fouling accumulation. The studs may be cast or molded with the body of the turbulence-inducing element, or can be welded to the body, or can be inserted into holes designed for that purpose and pinned into place.

Figure 15A:
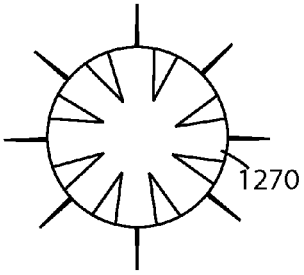
FIGS. 15A, 15B, and 15C are a downstream end view, side perspective view, and upstream end view, respectively, of an additional embodiment of a turbulence-inducing element of the present invention that has both grooves in the direction of fluid flow and protruding stud elements.
Figure 15B:
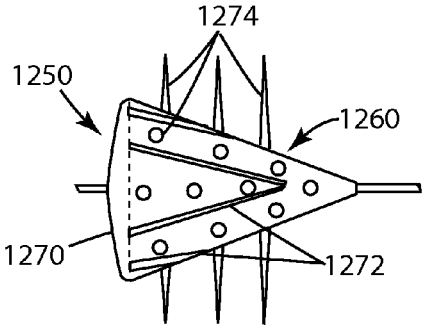
Figure 15C:
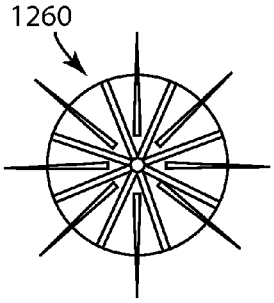

In a further embodiment, as shown in FIGS. 15A, 15B, and 15C, a turbulence-inducing element 1250 includes grooves 1272 distributed evenly about the circumference of the element 1250 (as described with reference to FIG. 13), and a first portion 1260 having conical studs 1274 distributed on its lateral surface (as described with reference to FIG. 14.)

Figure 16:
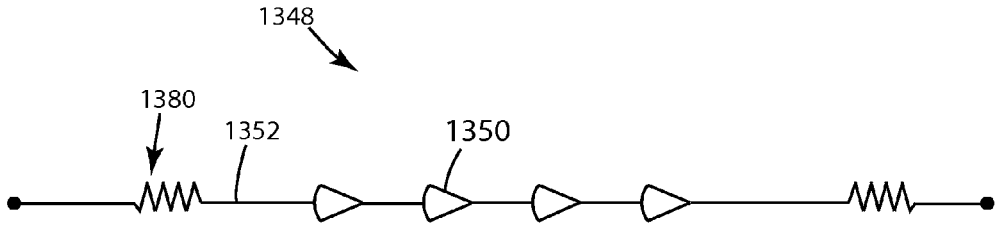
FIGS. 16-18 are longitudinal cross-sectional views of various embodiments of arrangements of turbulence-inducing elements according to the present invention including structures for accommodating expansion and contraction of the supporting member in the tube.

The arrangement of the turbulence-inducing elements within a tube can follow the general configuration shown and described above with respect to FIGS. 3A and 3B. In further embodiments, referring generally to FIGS. 16, 17 and 18, additional elements are included at certain locations on the structural support element to provide suitable tension and expansion capabilities to the apparatus of the present invention. In particular, FIG. 16 is a schematic illustration of an apparatus 1348 including a plurality of turbulence-inducing elements 1350 arranged along the structural support element 1352, similar to that described with respect to FIGS. 3A and 3B. In addition, a portion of the structural support element 1352 proximate each end is provided with springs 1380. The distal ends of the structural support element 1352 are attached to the linking wires at the tube ends in a manner similar to that described with respect to FIGS. 3A and 3B.

The spring 1380 is preferably formed as helical extension spring having coils that are suitably dimensioned and spaced apart so as to minimize or prevent the likelihood of fouling inside the spring and/or on the tube's inner wall surface proximate the spring. In particular, the outer coil diameter is smaller than the inside tube diameter, with sufficient clearance to prevent scraping of the inner tube wall. Further, the coil spacing, known as the "pitch" of a spring, is sufficiently large to allow fluid to flow through the spring without substantial resistance to minimize or prevent the likelihood of fouling inside the spring. For example, each spring element 1380 can have an outer diameter one-half of the tube's inside diameter, and the spacing between coils of the spring can be between the tube's inside diameter and the tube's outer diameter. It will be appreciated that the spacing between coils depends upon the tension and the coil factor, in addition to any stop ball that may be in place.

Advantageously, including one or more spring elements on the turbulence-inducing apparatus of the present invention facilitates installation of the apparatus, allows for stresses to be absorbed thereby reducing the stress load on the structural support element and the end connections, and maintains tension in the apparatus 1348 even under conditions of transferring fluid flow surge. In addition, spring elements can minimize the tendency of the structural support element 152 to expand longitudinally during operation due to high temperatures, and also to minimize the tendency of the turbulence inducing devices 150 to sag toward the bottom surface of the tube due to gravity. The use of the spring elements can such sag and maintain the turbulence-inducing elements the longitudinal centerline of the tube.

Figure 17:
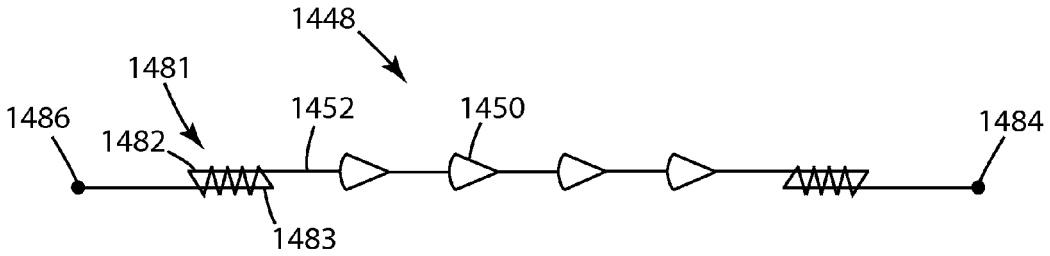

Referring now to FIG. 17, an apparatus 1448 includes a plurality of turbulence-inducing elements 1450 arranged along the structural support element 1452, with spring elements 1481 near each end. In particular, spring elements 1481 each include a first terminal end 1482 that extends through the coils of the spring elements to the turbulence-inducing element 1450, and a second terminal end 1483 that also extends through the coils, in the opposite direction as terminal end 1482, to each of the ends 1484, 1486 of the structural support element 1452. Accordingly, in the event of forces that cause displacement of the turbulence-inducing elements within the tube, the coils of the spring elements 1481 compress and the overall length of the structural support element 1452 increases by the compression length of the spring elements 1481. Such an arrangement allows for extension of the overall length of the structural support element 1452 while preventing overstretching of the spring elements 1481.

Figure 18:
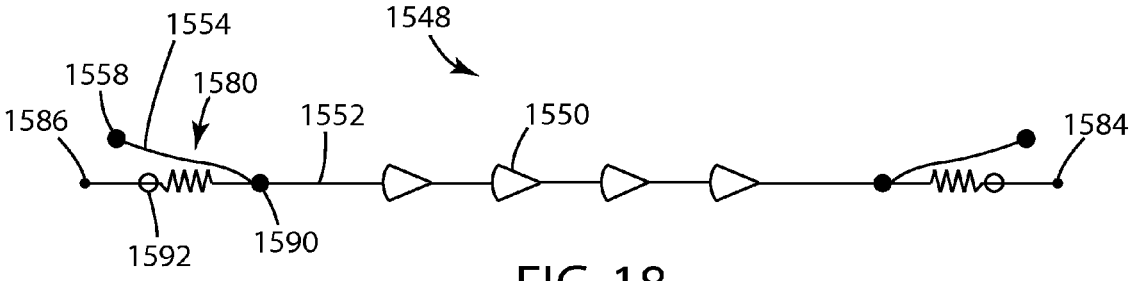

Referring now to FIG. 18, a further embodiment of an apparatus for use in a heat exchanger tube for promoting turbulence of transferring fluid and minimizing fouling and other detrimental effects associated with boundary layer accumulation is shown. In particular, apparatus 1548 includes a plurality of turbulence-inducing elements 1550 arranged along a structural support element 1552. A joint element 1590 is provided between a portion of the structural support element 1552 and a separate spring element 1580. At each end, the structural support element 1552 extends from the separate spring element 1580 to end 1584, 1586. An additional safety wire 1554 is connected at one end to the joint element 1590 and is connected at its other free end to a safety stop 1558, which is shown in FIG. 18 as a ball stop. The additional safety wire 1554 is inserted through the separate spring element 1580 and a sliding opening 1592 fixed to the structural support element 1552. (For purposes of illustration only, in FIG. 18 the additional safety wire 1554 is not inserted through the separate spring element 1580 and sliding opening 1592 and, therefore, is not shown in its operational position.) In FIG. 18, the sliding opening 1592 is shown as a ring. The benefit of the additional safety wire 1554 is that the safety stop 1558 can act as a brake or safety guard for preventing damage to the separate spring element 1580, by preventing the spring from stretching beyond a predetermined distance.

Figure 19A:
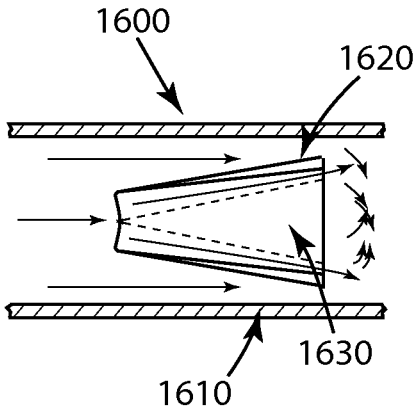
FIGS. 19A and 19B are a side perspective view and a downstream end view, respectively, of another embodiment of a turbulence-inducing element of the present invention.
Figure 19B:
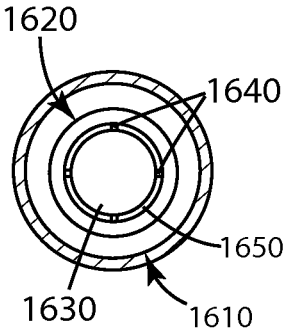

Referring now to FIGS. 19A and 19B, a further embodiment of an apparatus for use in a heat exchanger tube for promoting turbulence of transferring fluid and minimizing fouling and other detrimental effects associated with boundary layer accumulation is shown. FIG. 19A illustrates a side view of the embodiment in a heat exchanger tube 1610, and FIG. 19B illustrates a downstream end view of the embodiment. In particular, apparatus 1600 includes turbulence-inducing elements that are formed from an assembly of two cones, namely, an outer cone 1620 and an inner cone 1630 nested inside. The two cones are arranged such that an annular gap 1650 is formed between the outer cone 1620 and the inner cone 1630.

The outer cone 1620 is hollow. At the upstream end, the wall of the outer cone 1620 is relatively thin. At the downstream end, the wall of the outer cone 1620 is relatively thick. The inner cone 1630 includes a substantially closed outer surface and is affixed to the central wire in the same manner as described in the earlier embodiments.

The inner cone 1630 is connected to the outer cone 1620 via a plurality of longitudinal strips 1640 that are plate welded. It is preferable to use an even number of longitudinal strips to provide a symmetrical load which helps to maintain the cone assembly at the tube center. In a preferred embodiment, four longitudinal strips are utilized.

This embodiment will provide for more turbulence during fluid flow for more fluid mixing. In addition, because this configuration allows a portion of the transferring fluid to flow through the annulus gap between the two cones, it creates less erosion to the pipe's inner surface compared with the previously described embodiments. This embodiment is useful in situations where a large cone diameter is required for generating additional turbulence, which would otherwise cause erosion to the pipe's inner surface if some fluid was not permitted to flow through the inside of the cone assembly as described above.

Figure 20:
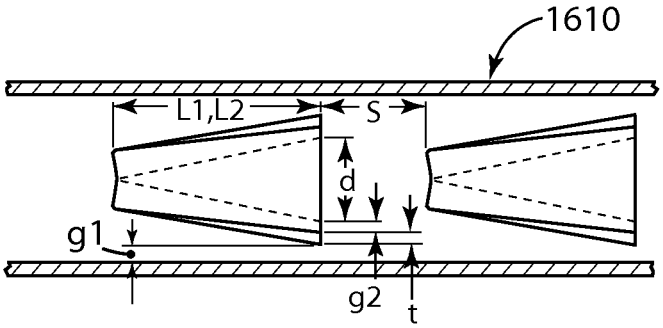
FIG. 20 is a diagram used to describe relative dimensions according to the embodiment illustrated in FIGS. 19A and 19B.

Referring to FIG. 20, the dimensions and spacing of the turbulence-inducing elements illustrated in FIGS. 19A and 19B relative to the tube size are described according to the below formulas, according to one example.

A gap (g1) is maintained between the inside tube diameter (ID) and the outer diameter of the outer cone 1620, according to the following formula:

$$g1=0.1*ID \tag{6}$$

A gap (g2) is maintained between the outer cone 1620 and the inner cone 1630, according to the following formula:

$$g2=0.1*ID \tag{7}$$

The thickness (t) of the base of the outer cone 1620 is determined according to the following formula:

$$t=0.15*ID \tag{8}$$

The diameter (d) of the base of the inner cone 1630 is determined according to the following formula:

$$d=ID-2*g1-2*g2-2*t \tag{9}$$

The length (L1) of the outer cone 1620 is the same as the length (L2) of the inner cone 1630 and is determined by the following formula:

$$L=1.5*ID \quad (10)$$

The spacing (S) between adjacent cone assemblies is determined by the following formula:

$$S=3.5*d/(g1+g2) \quad (11)$$

The cone assembly of this embodiment does not include a second portion extending towards the downstream end of the tube as was described with some of the above embodiments.

Advantageously, the apparatus of the present invention can be integrated in new or existing heat transfer devices. Unlike prior art systems that attempt to impart turbulence to fluid flowing in a heat transfer device, the apparatus of the present invention can be installed in clean or fouled existing tubes of a heat transfer device.

In addition, the turbulence-inducing devices of the present invention are not designed to contact the tube's inner surface during operation, unlike prior art systems that attempt to impart turbulence to fluid flowing in a heat transfer device.

In an alternative embodiment one or more radial supporting devices are installed on, and extend radially from the longitudinal support element to contact the adjacent wall of the tube. The supporting device can be constructed from one or more pieces of wire tubing or other rigid material to provide three or four points of contact with the inner surface of the tube to thereby maintain the structural support element aligned with the longitudinal axis of the tube. The arms can be spaced from each other at intervals of 120° or 90°. The radial supporting devices can also be fabricated by casting metal or plastic materials with radial arms extending from a central hub.

Referring again to FIG. 14, in yet another alternative embodiment, one or more radially-extending supporting devices are installed on, and extend radially from the surface of, the turbulence-inducing devices to contact the adjacent wall of the tube. In this embodiment, it is preferred that the radially-extending supports are positioned in groups at one or more circumferential locations along the longitudinal axis of the turbulence-inducing element, wherein adjacent circumferential groups are spaced from each other along the central axis of the turbulence-inducing element. In one example, a single circumferential group includes four radial supports, being spaced at substantially 90 degrees from each other. Preferably, each circumferential group includes radial supports in multiples of four. The length of each radial support depends on the shape of the turbulence-inducing element and the location of the radial support on the surface of the turbulence-inducing element. For example, referring to the turbulence-inducing element shown in FIG. 14, radial supports in a first circumferential group have lengths that differ from radial supports in an adjacent circumferential group, such that all of the radial supports extend a substantially uniform distance from the longitudinal axis of the element.

The special geometry and studs serve to center the device in the tube during operation, preventing or reducing build-up of deposits inside the tubes. Existing turbulent devices that are held in position by contacting the tube inner surface lead to fouling at the contact points with the tube surface. This complicates maintenance because of the difficulty of first removing the turbulent devices without damaging them and then cleaning the tubes.

The method and apparatus of the present invention have been described above and in the attached drawings; however, modifications will be apparent to those of ordinary skill in the art and the scope of protection for the invention is to be defined by the claims that follow.

I claim:

1. A heat exchanger tube for conveying a fluid having an inner surface and upstream and downstream ends, the tube comprising:

one or more turbulence-inducing elements positioned in the tube along a structural support element, wherein the ends of the structural support element are fixedly positioned at the upstream and downstream ends of the tube, the one or more turbulence-inducing elements configured and dimensioned to direct passing fluid toward the inner surface of the tube, wherein at least one of the one or more turbulence-inducing elements includes:

a first portion facing upstream, wherein the distal end of the first portion forms an apex that faces upstream;

the structural support element attached directly to the apex and extending axially from the apex, wherein the structural support element is disposed entirely within the tube; and a second portion facing downstream, wherein each of the turbulence-inducing elements is dimensioned and configured so that the exterior surface of the turbulence-inducing element does not touch the adjacent inner wall of the tube, wherein the entire exterior surface of the first portion forms a continuous solid surface that is configured to block and deflect the path of the passing fluid; wherein the first portion is conically configured or pyramidally configured.

2. The heat exchanger tube of claim 1 comprising a plurality of turbulence-inducing elements in predetermined spaced-apart relation.

3. The heat exchanger tube of claim 2, wherein at least one of the turbulence-inducing elements has a configuration that is different than the other or others of the turbulence-inducing elements.

4. The heat exchanger tube of claim 2, wherein the space (S) between adjacent turbulence-inducing elements is determined relative to the diameter (d) of at least one of the turbulence-inducing elements and a gap (g) maintained between the inside diameter (ID) of the tube and the outer diameter of the at least one of the turbulence-inducing element according to the following formula:

$$S=3.5\ d/g.$$

5. The heat exchanger tube of claim 1, where the distal end of the first portion is an apex and the second portion is defined by a convex surface.

6. The heat exchanger tube of claim 1, wherein the second portion commences at the base of the first portion.

7. The heat exchanger tube of claim 1, wherein the at least one turbulence-inducing element is symmetrical about the central axis extending from the first end portion to the second end portion.

8. The heat exchanger tube of claim 7, further comprising at least one groove on each symmetrical side of the at least one turbulence-inducing element extending along a straight line segment between the first end portion and a maximum cross-section region of the second end portion.

9. The heat exchanger tube of claim 7, further comprising at least one stud projecting from each symmetrical side of the at least one turbulence-inducing element.

10. The heat exchanger tube of claim 1, wherein a minimum gap (g) is maintained between the inside diameter (ID) of the tube and the outer diameter of the at least one turbulence-inducing element according to the following formula:

$$g \geq 0.25\ ID.$$

11. The heat exchanger tube of claim 10, wherein the diameter (d) of the at least one turbulence-inducing element is determined relative to the inside diameter (ID) of the tube, according to the following formula:

$$d = ID - 2g.$$

12. The heat exchanger tube of claim 1, wherein the length (L) of the at least one turbulence-inducing element is determined relative to the inside diameter (ID) of the tube according to the following formula:

$$1.25(ID) <= L <= 1.5(ID).$$

13. The heat exchanger tube of claim 1, wherein the depth (h) of the second portion extending towards the downstream end of the tube is determined relative to the diameter (d) of the at least one turbulence-inducing element according to the following formula:

$$0 \leq h \leq 0.25d.$$

14. The heat exchanger tube of claim 1, wherein the structural support element and the at least one turbulence-inducing element are formed as a unitary structure.

15. The heat exchanger tube of claim 14, wherein the structural support element and the at least one turbulence-inducing element are formed by casting.

16. The heat exchanger tube of claim 1, wherein the structural support element is attached to a fixed linking wire that extends across the upstream end of the tube and a fixed linking wire that extends across the downstream end of the tube.

17. The heat exchanger tube of claim 1, the structural support element further comprising at least one spring proximate to at least one of the upstream end and the downstream end of the tube.

18. The heat exchanger tube of claim 17, wherein the spring includes a core and a terminal end, wherein the terminal end loops within the core.

19. The heat exchanger tube of claim 17, further comprising a safety stop element between the spring and the proximate upstream end and/or downstream end of the tube.

20. A tube for a heat exchanger, the tube having an inner surface for contacting a transferring fluid, an outer surface for contacting a receiving fluid, an upstream end, and a downstream end, the tube comprising:

one or more turbulence-inducing elements positioned generally centrally in the tube along a structural support element, the one or more turbulence-inducing elements configured and dimensioned to direct transferring fluid toward the inner surface of the tube, wherein at least one of the one or more turbulence-inducing elements includes:

a first portion facing upstream, wherein the distal end of the first portion forms an apex that faces upstream;

a structural support element attached directly to the apex and extending axially from the apex, wherein the structural support element is disposed entirely within the tube; and a second portion facing downstream, wherein the second portion includes a closed outer surface;

wherein each of the turbulence-inducing elements is dimensioned and configured so that the exterior surface of the turbulence-inducing element does not touch the adjacent inner wall of the tube, wherein the entire exterior surface of the first portion forms a continuous solid surface that is configured to block and deflect the path of the transferring fluid; wherein the first portion is conically configured or pyramidally configured.

21. A turbulence-inducing element positioned in a tube to direct a flowing fluid toward an adjacent inner surface of the tube, the turbulence-inducing element comprising:

a first portion facing upstream, wherein the distal end of the first portion forms an apex that faces upstream;

a structural support element attached directly to the apex and extending axially from the apex, wherein the structural support element is disposed entirely within the tube; and a second portion facing downstream, wherein the turbulence-inducing element is dimensioned and configured so that the exterior surface of the turbulence-inducing element does not touch the adjacent inner surface of the tube, wherein the entire exterior surface of the first portion forms a continuous solid surface that is configured to block and deflect the path of the flowing fluid;

wherein the first portion is conically configured or pyramidally configured.

22. The element of claim 21 in which the distal end of the first portion is an apex and the second portion is a convex surface.

23. The element of claim 21 in which the second portion commences at the base of the first portion.

24. The element of claim 21 which is symmetrical about its axis.

25. The element of claim 24 which includes a plurality of grooves extending along straight lines extending from the first end portion to a maximum cross-section region of the second end portion.

26. The element of claim 24, further comprising a plurality of studs projecting from opposing positions along the side of the first portion.

27. The element of claim 21, further comprising a plurality of supporting devices that extend radially from the turbulence-inducing element, wherein the plurality of supporting devices are adapted to assist in maintaining the turbulence-inducing element aligned with the longitudinal axis of the tube.

28. The element of claim 27, wherein the turbulence-inducing element has at least four supporting devices and wherein four of the at least four supporting devices are uniformly and circumferentially spaced at 90 degrees apart from each other.

* * * * *